US005285915A

United States Patent [19]

Earl

[11] Patent Number: 5,285,915

[45] Date of Patent: Feb. 15, 1994

[54] LID FOR A GRAPE OR FRUIT CARTON

[75] Inventor: Gary L. Earl, Walterville, Oreg.

[73] Assignee: Anderson & Middleton Company, Hoquiam, Wash.

[21] Appl. No.: 994,994

[22] Filed: Dec. 22, 1992

[51] Int. Cl.[5] ..... B65D 5/22

[52] U.S. Cl. ..... 217/56; 217/66; 217/68; 217/69; 229/125.01

[58] Field of Search ..... 229/125.01, DIG. 4; 217/56, 68, 69, 66

[56] References Cited

U.S. PATENT DOCUMENTS

| | | | |
|---|---|---|---|
| 1,842,614 | 1/1932 | Kieckhefer | 229/125.01 |
| 2,298,452 | 10/1982 | Barker | 217/68 |
| 2,328,230 | 8/1943 | Rosenmund | 217/66 |
| 3,878,980 | 4/1975 | Crane | 217/69 |
| 4,096,987 | 6/1978 | Rodish | 229/DIG. 4 |

*Primary Examiner*—Joseph Man-Fu Moy

*Attorney, Agent, or Firm*—Nixon & Vanderhye

[57] ABSTRACT

A grape or fruit box includes a pair of laterally spaced, rigid ends, to which is secured a wrap assembly of paper overlay laminated veneer, extending substantially about the sides and bottom of the box. The ends are each formed with a groove extending from the right to left side of the end, and relatively closely adjacent the upper edge of the end. The groove extends parallel to the upper side of the end, and the lower edge of the groove is chamfered or bevelled along its entire length. The box lid or cover pad comprises a relatively thin and flexible sheet of laminated veneer or heavyweight paper. To secure the cover pad to the box, one end of the lid may be inserted in one groove of one end, and the lid then bowed upwardly in its center area, so that the opposite end of the lid may be located below the groove in the opposite end. By then pulling upwardly on that opposite pad end, the latter will snap into the groove, facilitated by the lower, chamfered edge of the groove.

10 Claims, 2 Drawing Sheets

LID FOR A GRAPE OR FRUIT CARTON

This invention relates to food cartons in general, and in particular to an improved lid design for a carton particularly suited for use in the field during harvesting of grapes or other small fruits.

BACKGROUND

There is currently a grape or fruit box in widespread use which nevertheless has certain disadvantages in terms of the number of parts and cost required to make the box. This well known box construction is illustrated in FIG. 1 at 10 and includes a pair of wood ends 12 and 14 (angled at all four corners) connected by a wrap assembly 16 which forms a bottom wall 18 and a remaining pair of opposed sides 20, 22. The wrap 16 is typically constructed of three relatively rigid sheets of wood veneer 18*a*, 20*a* and 22*a* which are used to form the sides 20, 22 and the box bottom wall 18, respectively. These sheets are covered with Kraft paper shown at 16*a*, and nailed or stapled to the lower edges respectively of ends 12, 14 (one such edge shown at 24) as well as along the front and back edges 26, 28 of end 14 and corresponding edges (one shown at 30) of end 12. The sides 20, 22 terminate short of the upper edges of the ends 12 and 14 to insure adequate ventilation. The wrap 16 may also include a plurality of ventilation apertures (not shown) in the areas between the veneer sheets.

In this commonly utilized construction, the upper edges of ends 12, 14, (one shown at 32) are each provided with a pair of nails 34, 36 and 38, 40 all of which extend upwardly from their respective associated edges a carefully chosen, uniform height.

A box lid 42, typically formed of a 1/20" thick veneer laminated with paper on either side, is stitched, stapled or otherwise secured to a pair of upper side cleats 44, 46 which may be nominal 5/16–½ inch × 1½ inch strips of wood. The cleats may be 11½ inches in length, extending from side to side at the ends of the box, whereas the ends 12, 14 may be 13½ inches in length. Cleats 44 and 46 are each provided with a pair of vertical slots (one pair shown at 48, 50) which open away from the respective ends of the box. It will be appreciated that the flexible nature of the lid 42 permits the lid to be bowed upwardly to thereby allow the lid to be placed on the box with nails 38, 40 received in slots 48, 50 and nails 34, 36 then received in similar but unseen slots in the cleat 44. With this arrangement, the nails and slots cooperate to retain the lid 42 in place on the box 10 until such time as the lid is pulled upwardly a distance sufficient to dislodge at least one pair of nails from their associated slots in one of the upper cleats. The upward bowing of the lid also accommodates a level of contents in the box which exceeds in some areas the upper edges of the ends 12 and 14.

Bottom cleats 52, 54 are fixed to the lower edges of ends 12, 14, and provide a stacking base which may be aligned with and supported by a pair of upper cleats on an underlying box.

With the above described construction, it will be apparent that the cost of the overall assembly could be significantly reduced with a simpler lid construction which would eliminate the need for the upper wood cleats, but which would retain the same manner of assembly.

SUMMARY OF THE INVENTION

It is the principal object of this invention to eliminate the need for a multi-part lid thereby simplifying the manufacture assembly of the box, improving overall reliability and durability, and reducing cost.

In the exemplary embodiment, the box includes a pair of laterally spaced, rigid ends, to which is secured a wrap assembly of veneer (or other suitable material), extending substantially about three sides of the box as in the conventional construction described above. Unlike the conventional construction, however, the carton lid is significantly simplified in that it is of one piece construction. More specifically, the lid, which is constructed of finely corrugated paper known as E-flute, or other suitable heavyweight paper (or other suitable material), is formed with a Z-fold along opposite end edges to thereby reinforce the end edges. At the same time, the Z-fold end edges are each provided with a pair of outwardly facing notches adapted to receive the nails in the carton ends in much the same manner as the notches in the upper wood cleats of the conventional lid construction.

Accordingly, in a first exemplary embodiment of the invention, there is broadly provided an improved lid for a box construction used in harvesting grapes or other small fruit, the box formed by a pair of wood ends connected by a member forming sides and a bottom, the improvement comprising a one-piece lid having opposite edge portions adapted to be secured to the pair of wood ends, the edge portions each defined by an integral Z-fold.

In another aspect, the invention provides a box lid comprising a substantially planar main portion having opposed side and opposed end edges, the opposed end edges each reinforced by at least one folded portion providing at least a double thickness along the end edges, and a pair of open-ended notches extending through the double thickness.

In still another aspect, the invention provides a box construction for use in harvesting grapes and other small fruits, the box comprising a pair of end boards connected by sides and a bottom formed by a flexible paper overlay veneer wrap which terminates at upper edges of the sides which are located below upper edges of the end boards; each of the end boards having a pair of upstanding members, and a one-piece lid having side edges and end edges, the end edges reinforced by a Z-fold, each Z-fold having a pair of open-ended slots for receiving respective ones of said upstanding members.

Additional objects and advantages of the invention will become apparent from the detailed description which follows.

DETAILED DESCRIPTION OF THE DRAWINGS

Figure 2:
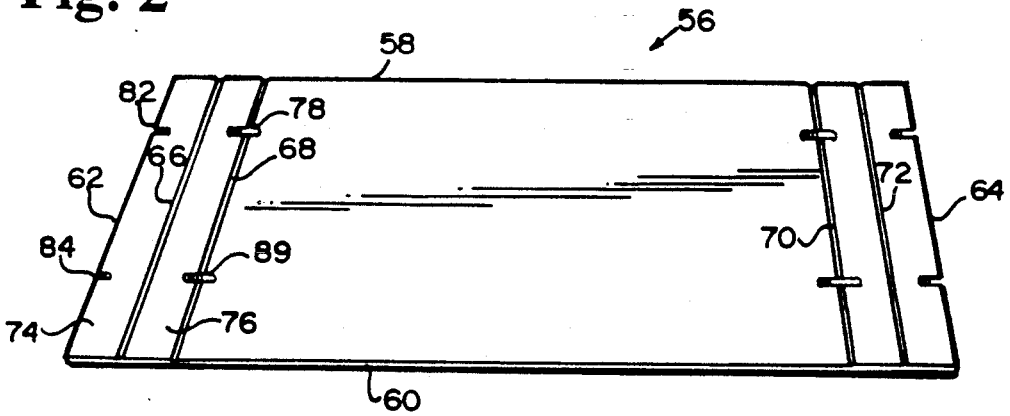
FIG. 2 is a perspective view of a lid blank in accordance with this invention.

With reference now to FIG. 2, a lid blank 56 is shown, having a substantially rectangular shape including side edges 58, 60 and end edges 62, 64. The blank 56 is provided with fold lines 66, 68 and 70, 72 extending in pairs substantially parallel and in relative proximity to the end edges 62 and 64. Since the end edge configurations on opposite ends of the box are identical, only one need be described in detail. With reference to the left hand side of the blank 56 as seen in FIG. 2, fold lines 66, 68 define adjacent fold panels 74, 76. The fold lines 66, 68 may be impressed into the lid 56 by rollers or other similar means.

A pair of elongated closed slots or apertures 78 and 80 span the inner fold line 68 and, at the same time, a pair of open-ended slots 82, 84 are provided along the end edge 62 in substantial lateral alignment with the apertures 78, 80, respectively.

Figure 3:
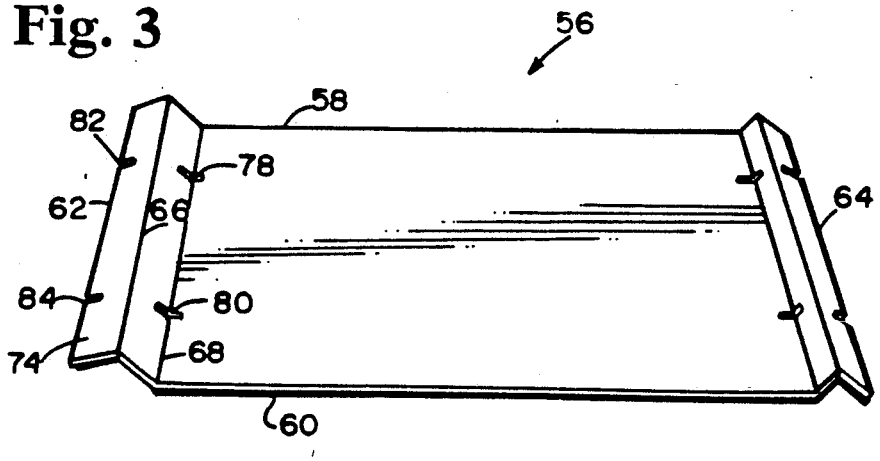
FIG. 3 is a perspective view of the lid blank shown in FIG. 1 but partially folded along opposite ends thereof.
Figure 4:
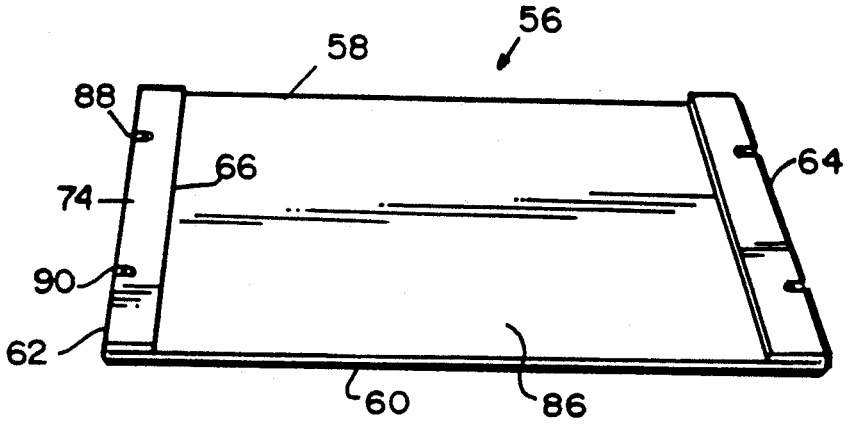
FIG. 4 is a perspective view of a completed lid in accordance with this invention.
Figure 5:
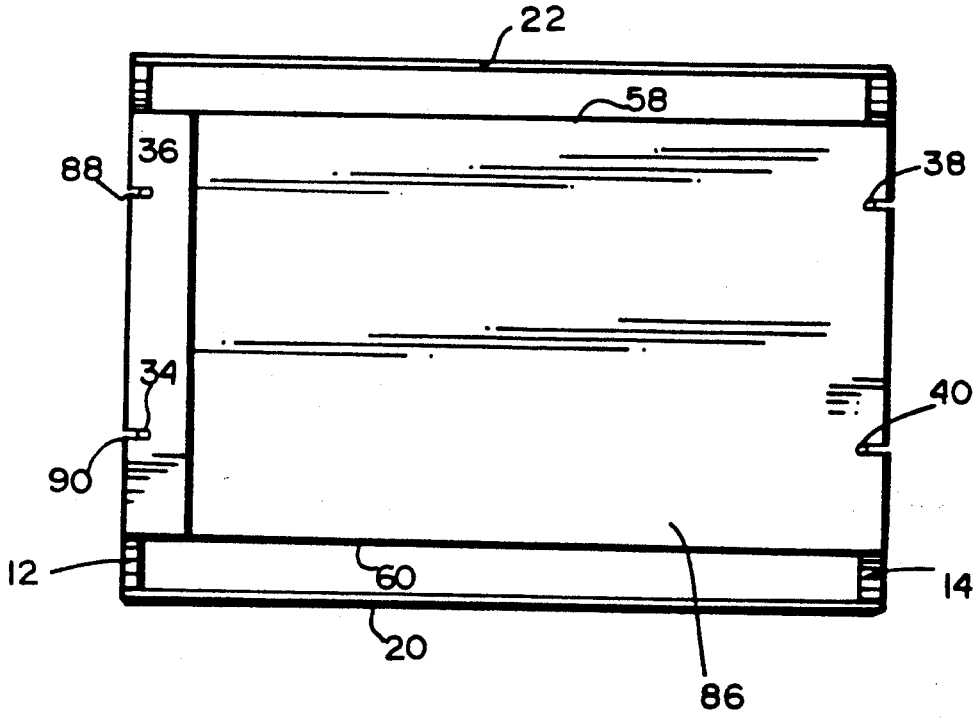
FIG. 5 is a plan view of the lid in accordance with this invention assembled to an otherwise conventional box.

With reference now to FIGS. 3 and 4, it will be seen that in the formation of the lid, the panels 74, 76 are folded about fold lines 66 and 68 to form a Z-fold configuration as shown in FIG. 4. More specifically, the inner panel 76 is folded back onto the main body portion 86 of the lid, while the outer panel 74 is folded onto the back surface of the inner fold panel 76 to thereby form a Z-fold reinforcement along the end edge of the lid. In so doing, it will be appreciated that the open-ended slots 82 and 84 as well as that half of each of the elongated apertures 78 and 80 which lie within the inner panel 76, will overlie the remaining halves of apertures 78 and 80 to form open-ended notches 88 and 90, best seen in FIG. 4. These open-ended notches extend through the three-layer Z-fold, and are adapted to receive the upstanding nails in the box ends as described below.

Figure 1:
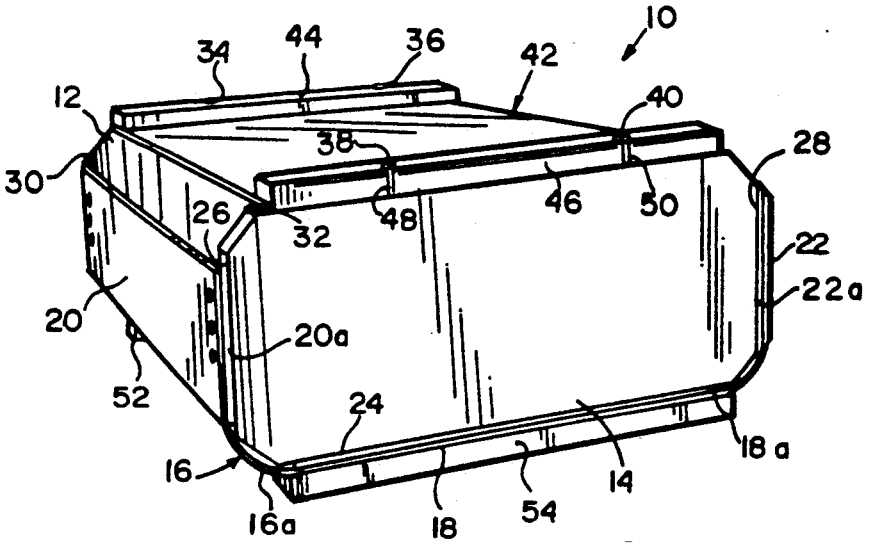
Fig. 1 (PRIOR ART)
FIG. 1 is a perspective view of a conventional grape or small fruit carton.

The improved lid may be assembled to the otherwise conventional box construction in much the same manner as the lid 42 shown in FIG. 1. In other words, the user would orient the lid so that one pair of nails 34 and 36 would be received in the slots 88 and 90 and the main body portion 86 of the lid bowed upwardly so that the remaining slots 92 and 94 may be positioned to receive the remaining pair of nails 38 and 40. Slots or notches 88, 90 cooperate with their associated nails (and nail heads) to retain the lid on the box. Removal of the lid is accomplished in substantially the same manner as the conventional lid.

The improved lid in accordance with this invention is preferably formed of a finely corrugated paper known as E-flute, a 275 pound weight paper. Other materials such as solid fiber paper may also be utilized for the improved lid construction. By reason of the one-piece construction, the improved lid of this invention eliminates the need for cleats 44 and 46 previously employed to secure the body of the lid to the end boards of the box.

The Z-fold may be secured in the folded position illustrated in FIG. 4 by utilization of cold or hot melt adhesive, with or without the further use of metal staples, or by conventional stitching techniques.

The above described improved lid construction eliminates the need for upper wood cleats as in the prior list construction. The lower cleats may be retained for stacking purposes, but may be removed if desired. This is because with the improved lid construction, stacking may take place such that end boards of an upper box would rest directly on the Z-fold reinforced ends of the lid of a lower box. Lower cleats may be desirable, however, if it is desirable or necessary to provide additional space between adjacent stacked boxes to accommodate an upward bowing of the lid by the box contents.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. In a box construction for use in harvesting grapes or other small fruit, the box formed by a pair of wood ends connected by a member forming sides and a bottom, the improvement comprising:

a one-piece lid having opposite edge portions adapted to be secured to said pair of wood ends, said end edge portions each defined by an integral Z-fold, and wherein said wood ends each have a pair of upstanding nails extending from upper surfaces thereof, and said Z-fold end edge portions are provided with open-ended slots for receiving said nails.

2. The box construction of claim 1 wherein said lid is formed of E-flute cardboard.

3. The box construction of claim 1 wherein said lid comprises heavyweight paper.

4. The box construction of claim 1 wherein said Z-fold is formed by a pair of fold panels defined by fold lines running substantially parallel to each of said end edges.

5. The box construction of claim 3 wherein said lid comprises heavyweight paper.

6. The box construction of claim 4 wherein said Z-fold is formed by a pair of fold panels defined by fold lines running substantially parallel to each of said end edges.

7. A box lid comprising:

a substantially planar main portion having opposite end edges each reinforced by at least one folded portion providing at least a double thickness along said end edges, and each of said opposite end edges formed with a pair of open-ended notches extending through the double thickness.

8. The box lid of claim 7 wherein said opposite end edges are each reinforced by two folded portions providing a triple thickness along said end edges, and wherein said open-ended notches extend through the triple thickness.

9. A box construction for use in harvesting grapes and other small fruits, said box comprising a pair of end boards connected by sides and a bottom formed by a flexible paper overlay veneer wrap which terminates at upper edges of said sides which are located below upper edges of said end boards; each of said end boards having a pair of upstanding members, and a one-piece lid having a main body portion, side edges and end edges, said end edges reinforced by a folded portion of at least triple thickness having a pair of open-ended slots for receiving respective ones of said upstanding members.

10. The box construction of claim 9 wherein said lid is formed of E-flute cardboard.

* * * * *